US007229038B1

(12) United States Patent
Givonetti

(10) Patent No.: US 7,229,038 B1
(45) Date of Patent: Jun. 12, 2007

(54) PASTEL STICK SHARPENER

(75) Inventor: Raymond Givonetti, Knoxville, TN (US)

(73) Assignee: Jerry's Artarama, Raleigh, NC (US)

( * ) Notice: Subject to any disclaimer, the term of this patent is extended or adjusted under 35 U.S.C. 154(b) by 445 days.

(21) Appl. No.: 10/950,761

(22) Filed: Sep. 27, 2004

(51) Int. Cl.
*B43L 23/00* (2006.01)

(52) U.S. Cl. ..... 241/95; 30/455; 7/678; 19/73

(58) Field of Classification Search ..... 241/95; 30/455; D19/73; D7/678; 131/231–242.6
See application file for complete search history.

(56) References Cited

U.S. PATENT DOCUMENTS 575,947 A * 1/1897 Hart ..... 30/455
1,666,215 A * 4/1928 Miller ..... 131/236
2,087,101 A * 7/1937 Cerracchio ..... 241/95
2,653,576 A * 9/1953 Slattery ..... 30/455
2,786,476 A * 3/1957 Garson ..... 131/242.6
4,616,748 A 10/1986 Thomas et al.
6,397,479 B1 6/2002 Luttgens
6,620,214 B2 9/2003 McArdle et al.

* cited by examiner

*Primary Examiner*—Derris H. Banks
*Assistant Examiner*—Jason Y. Pahng
(74) *Attorney, Agent, or Firm*—Pitts & Brittian, PC

(57) ABSTRACT

A device for sharpening and shaping pastel sticks, and for storing pastel powder collected. The pastel stick sharpener is comprised generally of a powder receptacle, a screen removably carried by the powder receptacle, and a lid for securing the screen and for selectively sealing the volume within the receptacle. The receptacle defines an opening adapted to receive the screen. The screen defines a collar at an upper end thereof. The lid includes a ring and a seal member. The ring is configured to be received over the receptacle opening and the screen such that the screen is securely mounted within the receptacle. The lid ring defines a central opening, through which a pastel stick to be sharpened is passed. The seal member is removable for sharpening a pastel stick and replaceable in order to retain the contents of the receptacle.

18 Claims, 5 Drawing Sheets

PASTEL STICK SHARPENER

CROSS-REFERENCE TO RELATED APPLICATIONS

Not Applicable

STATEMENT REGARDING FEDERALLY SPONSORED RESEARCH OR DEVELOPMENT

Not Applicable

BACKGROUND OF THE INVENTION

1. Field of Invention

The present invention pertains to the field of art. More specifically, the present invention is related to a device for sharpening and shaping pastel sticks and separately storing individual colors of pastel powder generated such processes.

2. Description of the Related Art

In the field of art, pastels are commonly used. Pastel sticks are fabricated from compressed chalk and pigment. Pastels are applied to a selected medium by rubbing the pastels against the surface of the medium.

It is well known that during use, the shape of a pastel stick becomes blunt or otherwise changes shape. It is therefore desirable to sharpen or shape the end of the pastel stick for the particular use. When sharpening a pastel stick, pastel dust is generated. Many artists reuse pastel dust by applying it to their artwork to create various shades or hues of that particular color. Pastel dusts of various colors can also be mixed to vary the coloring applied to the artwork. However, collection and reuse of pastel dust has heretofore been limited to collection and reuse at the time the dust is generated.

Typical methods of sharpening and shaping pastel sticks include using sandpaper or the like. The pastel stick is moved across the sandpaper, thus removing material from the pastel stick. A substantial portion of the pastel dust generated is collected in the sandpaper and is thus lost. When the sandpaper becomes cogged, it is discarded for a new, clean piece. Thus, not only is pastel dust lost in the sandpaper, but a continuing expense is created by the disposal of the sandpaper.

It is known that an alternative to sandpaper for this application is a flat screen. As the pastel stick is moved over the surface of the screen, the individual filaments serve to remove material from the pastel stick, with the pastel dust falling through the screen and discarded.

Other devices have been developed for sharpening and storing pastels, soft core pencils, and for forming particulate matter. Typical of the art are those devices disclosed in the following U.S. patents:

| U.S. Pat. No. | Inventor(s) | Issue Date |
|---|---|---|
| 4,616,748 | W. R. Thomas et al. | Oct. 14, 1986 |
| 6,397,479 | F. Lüttgens | Jun. 4, 2002 |
| 6,620,214 | J. L. McArdle et al. | Sep. 16, 2003 |

Of these patents, Thomas et al., (748) disclose a container for storing and transporting pastels. The '748 device is further provided for removing discoloring pastel dust from the pastels. The container holds a stack of trays, each made from a frame that surrounds and supports an open mesh on which pastels can be placed. The trays are supported above a volume of freely flowing granular abrasive in the bottom of the container which can scour the pastel dust from the surfaces of the pastels. When the container is inverted, the trays are held in place by the stack and the pastels are protected against breakage by the abrasive, which surrounds and scours the pastels.

Lüittgens ('479) discloses a sharpener for soft-core pencils. The '479 device includes a sharpener housing which carries a sharpener blade positioned tangentially in relation to a sharpener channel. The sharpener portion of the '479 device is similar to that of many prior art pencil sharpeners. The housing also has a free space that is open on a lower side of the housing. A core shaper can be introduced, preferably pivoted, from the lower side of the housing into the free space through a carrier plate which carries the core shaper and can be secured on the sharpener housing.

The '214 patent issued to McArdle et al., discloses a device for making ceramic aggregate particles. Ceramic aggregate precursor particles are formed from a composition by forcing the composition through at least one orifice in a substrate. The substrate is a screen which, in the illustrated embodiment, defines a frusto-conical configuration.

BRIEF SUMMARY OF THE INVENTION

The present invention is a device for sharpening and shaping pastel sticks. The device of the present invention is further provided for storing pastel powder collected using the sharpener of the present invention such that it may later be reused by the artist. The pastel stick sharpener is comprised generally of a powder receptacle, a screen removably carried by the powder receptacle, and a lid for securing the screen and for selectively sealing the volume within the receptacle.

The receptacle defines an opening adapted to receive the screen. The receptacle is fabricated from a transparent material such that the contents within the receptacle are readily discernable. Specifically, a user can readily observe the color and volume of pastel powder within the receptacle, as well as whether a screen is stored therein. A male threaded portion is defined about the opening for cooperatively engaging a female threaded portion of the lid.

The screen defines a selected configuration for sharpening and shaping a pastel stick as desired. In one embodiment, the screen defines a conical configuration, thereby providing a means for achieving a conical point on the pastel stick. The screen defines a collar at an upper end thereof. The collar defines an opening configured to cooperate with the receptacle opening for receiving a pastel stick. The body of the screen extends from the collar opening and into the receptacle.

The lid includes a ring and a seal member. The ring is configured to be received over the receptacle opening and the screen such that the screen is securely mounted within the receptacle. The screen collar is configured to be received between the receptacle and the lid ring such that when the lid ring is secured to the receptacle, the collar, and thus the screen, is held in place. The lid ring defines a central opening, through which a pastel stick to be sharpened is passed. The lid ring opening is approximately equal to the collar opening in order to maximize the amount of useful area on the screen.

The seal member is removable for sharpening a pastel stick and replaceable in order to retain the contents of the receptacle. The seal member is configured to be closely received within the threaded portion of the lid ring and to cover the lid ring opening. When the sharpener is not being used to sharpen or shape a pastel stick, the lid ring is removed, the seal is placed over the receptacle opening, and the lid ring replaced. In so doing, the pastel powder received within the receptacle is retained.

In order to better secure the screen within the receptacle, at least one ring is provided. A first ring is received above the screen collar and a second ring is received below the screen collar. Each of the first and second rings is configured to be received within the lid ring, and defines an opening approximately coinciding with the lid ring opening.

The screen is fabricated in any one of various methods. In one embodiment, the conical portion of the screen defines a region of overlap, wherein first and second ends of the screen material are overlapped and secured one to the other. In another embodiment, the first and second ends of the screen material are secured to form an outwardly extending tab. This embodiment substantially eliminates any inconsistencies in the conical portion of the screen.

BRIEF DESCRIPTION OF THE SEVERAL VIEWS OF THE DRAWINGS

The above-mentioned features of the invention will become more clearly understood from the following detailed description of the invention read together with the drawings in which.

DETAILED DESCRIPTION OF THE INVENTION

Figure 1:
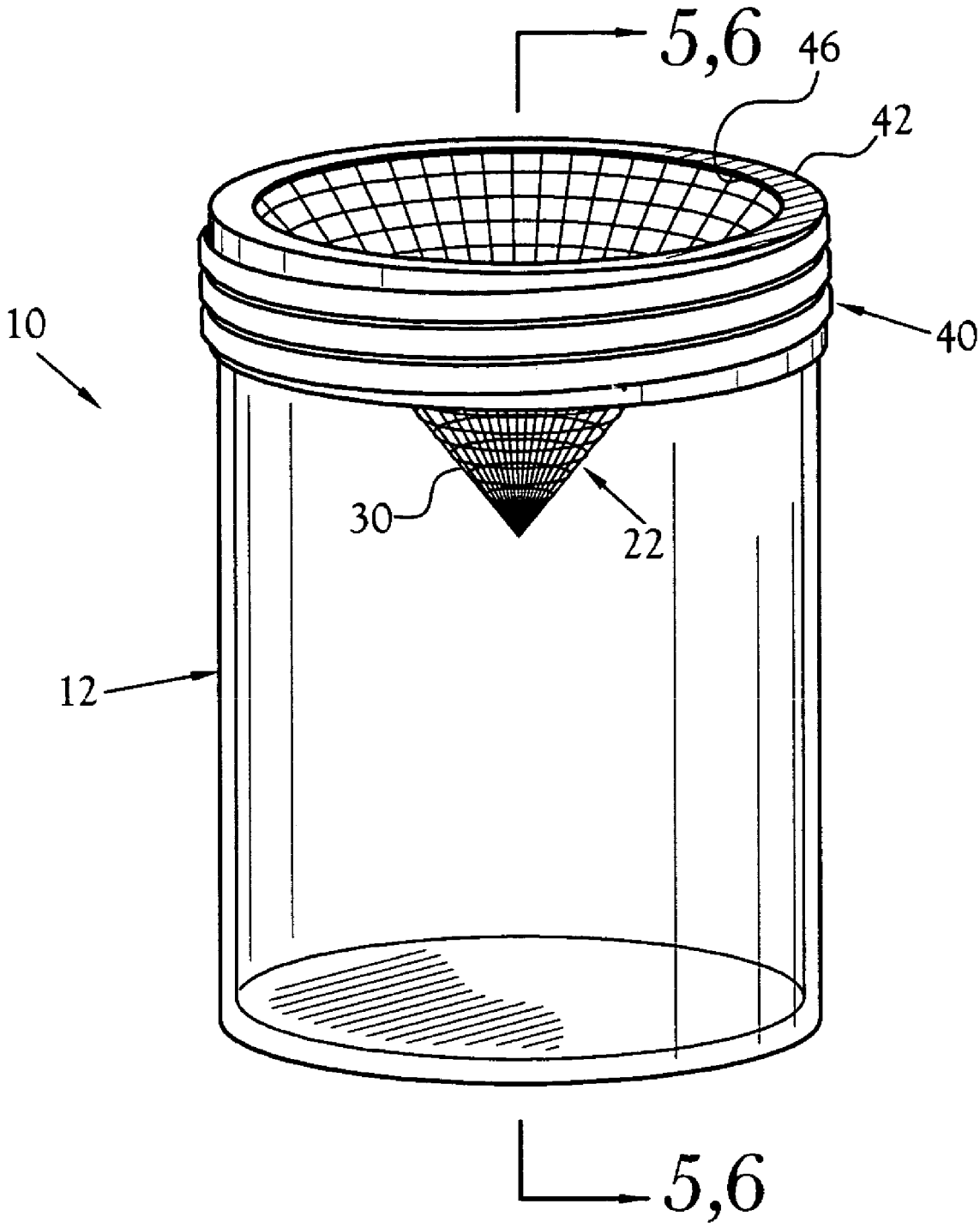
FIG. 1 is a perspective view of a device for sharpening and shaping pastel sticks made in accordance with several features of the present invention.

A device for sharpening and shaping pastel sticks is disclosed. The device of the present invention is further provided for storing pastel powder collected using the sharpener of the present invention such that it may later be reused by the artist. The pastel stick sharpener is illustrated generally at 10 in the figures. As illustrated in FIG. 1, the pastel stick sharpener, or sharpener 10, is comprised generally of a powder receptacle 12, a screen 22 removably carried by the powder receptacle 12, and a lid 40 for securing the screen 22 and for selectively sealing the volume 16 within the receptacle 12.

Figure 2:
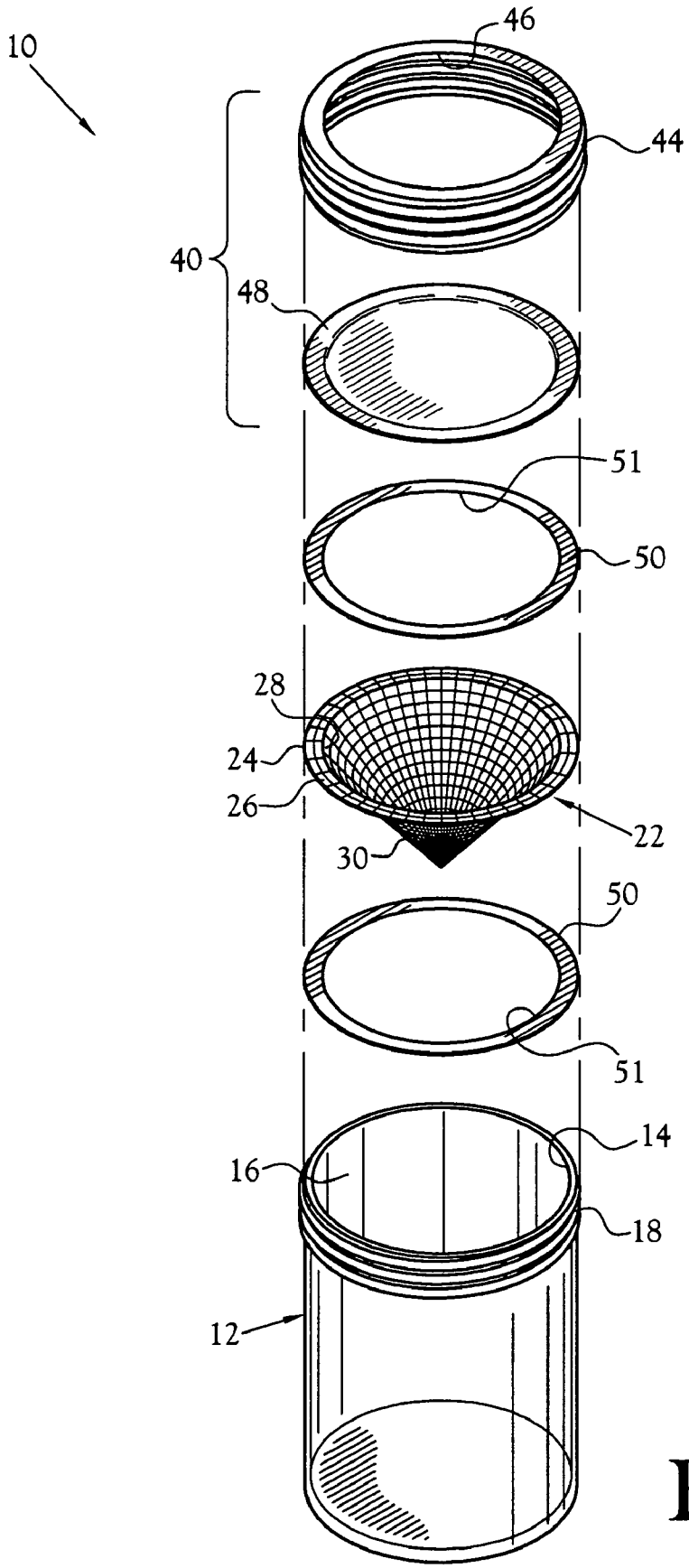
FIG. 2 is a perspective view of the device of FIG. 1 show in exploded view in order to more clearly illustrate the features of the individual components of the device.

As more clearly illustrated in FIG. 2, the receptacle 12 of the present invention is any receptacle 12 defining an opening 14 adapted to receive the screen 22. The opening 14 provides access to the interior volume 16 of the receptacle 12 for receipt and storage of the pastel powder 54. In the illustrated embodiment, the receptacle 12 is fabricated from a transparent material such that the contents within the receptacle 12 are readily discernable. Specifically, a user can readily observe the color and volume of pastel powder 54 within the receptacle 12, as well as whether a screen 22 is stored therein. A male threaded portion 18 is defined about the opening 14 for cooperatively engaging a female threaded portion 44 of the lid 40. While such an engagement device is illustrated and described, it will be understood that other conventional methods of securing the lid 40 to the receptacle 12 may be incorporated within the spirit of the present invention.

The screen 22 defines a selected configuration for sharpening and shaping a pastel stick 52 as desired. In the illustrated embodiment, the screen 22 defines a conical configuration, thereby providing a means for achieving a conical point on the pastel stick 52. The screen 22 defines a collar 26 at an upper end 24 thereof. The collar 26 defines an opening 28 configured to cooperate with at least a portion of the receptacle opening 14 for receiving a pastel stick 52. The lower end or body 30 of the screen 22 extends from the collar opening 28 and into the interior 16 of the receptacle 12. It will be understood that other geometric configurations may be used with similar success at acquiring corresponding geometric configurations on the pastel stick 52 as required.

The lid 40 includes a ring 42 and a seal member 48. The ring 42 is configured to be received over the receptacle opening 14 and the screen 22 such that the screen 22 is securely mounted within the receptacle 12. The screen collar 26 is configured to be received between the receptacle 12 and the lid ring 42 such that when the lid ring 42 is secured to the receptacle 12, the collar 26, and thus the screen 22, is held in place. The lid ring 42 defines a central opening 46, through which a pastel stick 52 to be sharpened is passed. In the preferred embodiment, the lid ring opening 46 is approximately equal to the collar opening 28 in order to maximize the amount of useful area on the screen 22. As discussed above, the lid ring 42 defines a female threaded portion 44 for cooperatively engaging the male threaded portion 18 defined by the receptacle 12.

Figure 5:
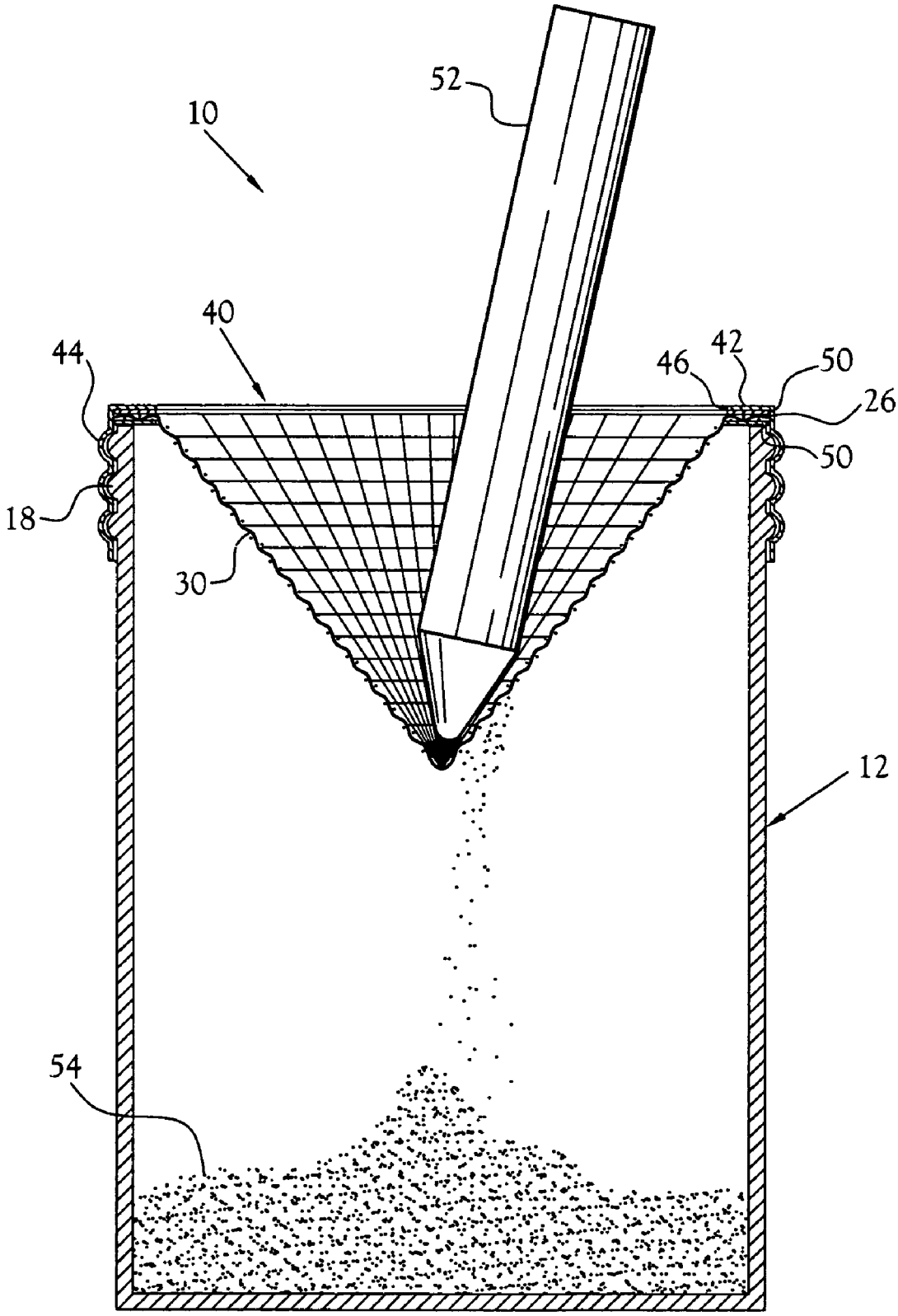
FIG. 5 is an elevation view, in cross-section taken along lines 5-5 of FIG. 1, showing a screen in place for sharpening and shaping a pastel stick.
Figure 6:
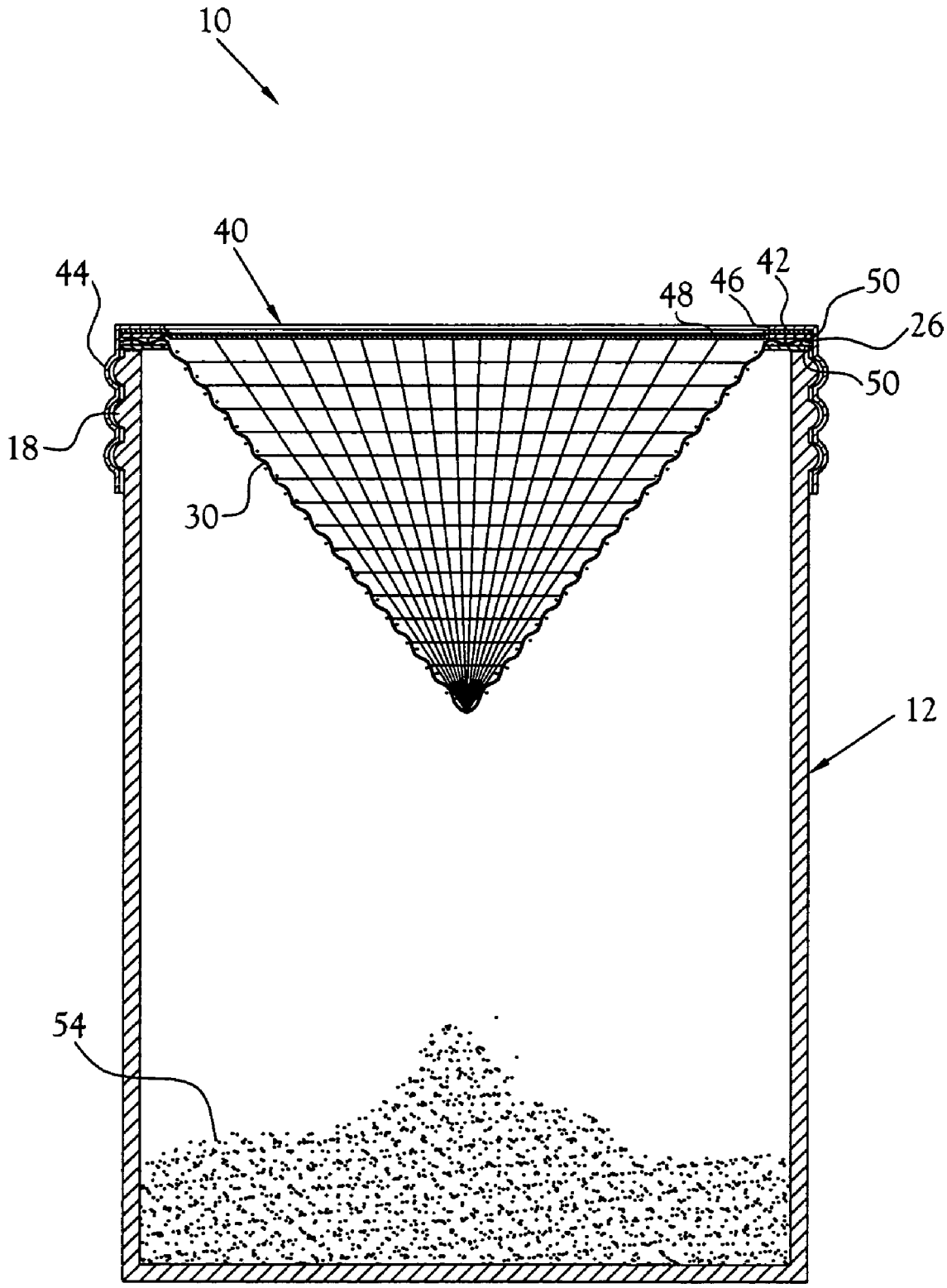
FIG. 6 is an elevation view, in cross-section taken along lines 6-6 of FIG. 1, showing the screen removed and the lid seal in place for storing pastel powder.

The seal member 48 is removable for sharpening a pastel stick 52, as illustrated in FIG. 5, and replaceable in order to retain the contents of the receptacle 12, as illustrated in FIG. 6. The seal member 48 is configured to be closely received within the threaded portion 44 of the lid ring 42 and to cover the lid ring opening 46. Specifically, when the sharpener 10 is not being used to sharpen or shape a pastel stick 52, the lid ring 42 is removed, the seal member 48 is placed over the receptacle opening 14, and the lid ring 42 replaced. In so doing, the pastel powder 54 received within the receptacle 12 is retained.

In order to better secure the screen 22 within the receptacle 12, at least one ring 50 is provided. In the illustrated embodiment, a first ring 50 is received above the screen collar 26 and a second ring 50 is received below the screen collar 26. Each of the first and second rings 50 is configured to be received within the lid ring 42, and defines an opening 51 approximately coinciding with the lid ring opening 46. In the embodiment of FIG. 2, the first and second rings 50 are separable from the screen 22. However, in the embodiments illustrated in FIGS. 3 and 4, the first and second rings 50 are secured to the screen collar 26. In the latter embodiment, the first and second rings 50 add rigidity to the screen 22, thus making it more difficult to push the screen 22 out of engagement with the powder receptacle 12 while sharpening or otherwise shaping a pastel stick 52. While a ring 50 has been illustrated and described, it will be understood that these may be omitted or replaced with other devices with similar results to those described.

Figure 3:
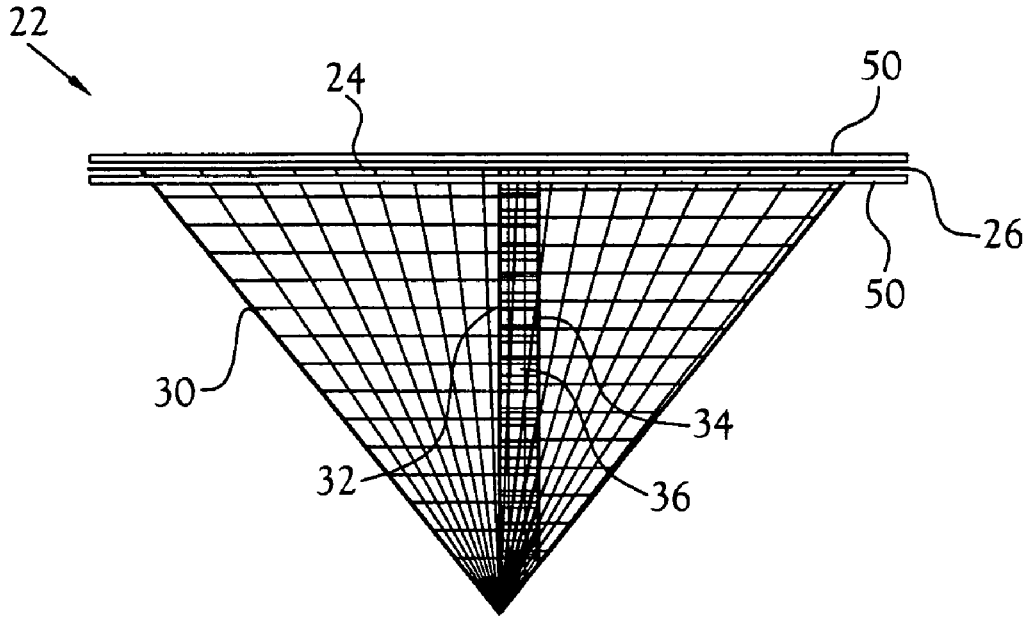
FIG. 3 is an elevation view of the screen of the present invention.
Figure 4:
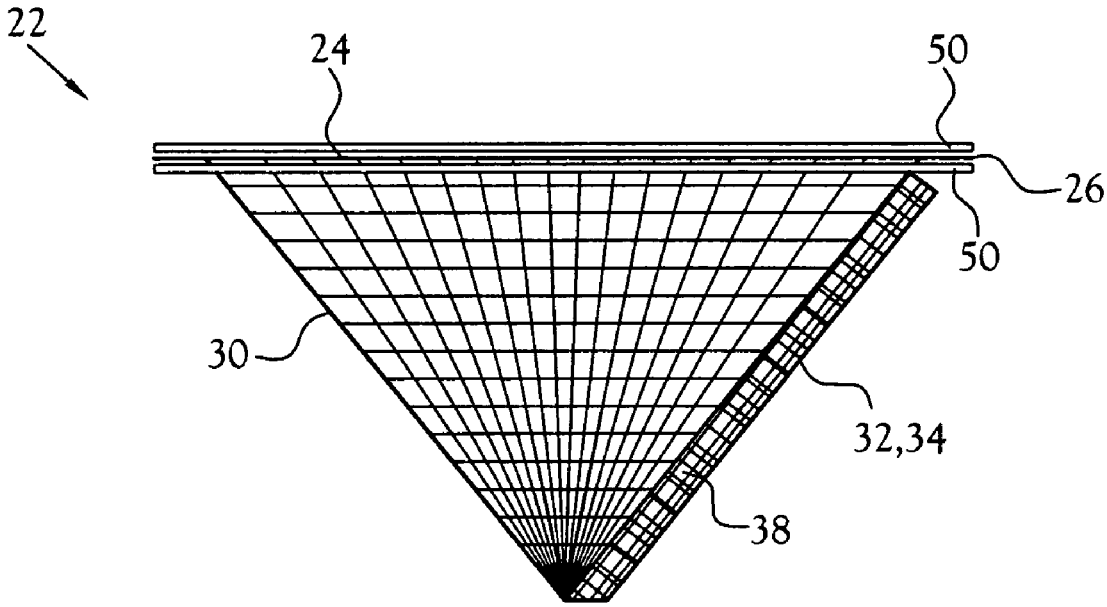
FIG. 4 is an elevation view of an alternate embodiment of the screen of the present invention.

As illustrated in FIGS. 3 and 4, the screen 22 may be fabricated in any one of various methods. As shown in FIG. 3, the body 30 of the screen 22 defines a conical configuration having a region of overlap 36, wherein first and second ends 32,34 of the screen 22 are overlapped and secured one to the other. While the sharpening and shaping properties are altered in this region 36, it has been found to accomplish the goals of the present invention. In the embodiment of FIG. 4, the first and second ends 32,34 of the screen 22 are secured to form an outwardly extending tab 38. This embodiment substantially eliminates any inconsistencies in the body 30 of the screen 22. In either of these embodiments, the first and second ends 32,34 of the screen 22 are secured one to the other by conventional means. It will be understood that the screen 22 may be formed by other methods as well, including but not limited to shaping a single, uncut screen material into the desired geometric shape by stretching the screen material.

Illustrated in FIG. 5 is a cross-sectional view of the sharpener 10 wherein a pastel stick 52 is being sharpened. By engaging the distal end of the pastel stick 52 in the bottom of the screen 22 and rotating the pastel stick 52, a conical shape is formed on the end of the pastel stick 54. However, the pastel stick 54 may also be selectively shaped by moving the pastel stick up and down, side to side, or in any other direction desired. Accordingly, it will be understood for purposes of the present disclosure that "sharpening" and "shaping" are intended to be interchangeable and to include within their scope any form or shaping or sharpening whereby the pastel stick 52 is moved across the screen 22 in any direction to remove material from the pastel stick 52 in the form of pastel powder 54 in order to accomplish any selected geometric configuration on the pastel stick 52.

Finally, illustrated in FIG. 6 is a cross-sectional view of the sharpener 10 shown with the lid seal 48 in place. In this arrangement, the pastel powder 54 is retained within the receptacle 12 for storage and later reuse. It will be understood that these pastel powders 54 may be stored separately, or may be combined as desired to attain selected other colors and hues. As illustrated in this embodiment, the screen 22 is storable within the receptacle 12 when not in use. However, it will be understood that the screen 22 is removable for use in other receptacles 12 as desired. As such, one may acquire any number of receptacles 12 while only requiring a few screens 22. While one screen 22 is all that is required, several may be desired when working with more than one pastel color in order not to have to remove and replace the screen 22 numerous times while working with the pastel sticks 52.

From the foregoing description, it will be recognized by those skilled in the art that a device for sharpening and shaping pastel sticks has been provided. The device of the present invention is further provided for storing and organizing pastel powder collected. The pastel stick sharpener is comprised generally of a powder receptacle, a screen removably carried by the powder receptacle, and a lid for securing the screen and for selectively sealing the volume within the receptacle. The screen is removable in order to access the powder within the receptacle, and further for use with a further receptacle for sharpening and shaping a pastel stick of another color.

While the present invention has been illustrated by description of several embodiments and while the illustrative embodiments have been described in considerable detail, it is not the intention of the applicant to restrict or in any way limit the scope of the appended claims to such detail. Additional advantages and modifications will readily appear to those skilled in the art. The invention in its broader aspects is therefore not limited to the specific details, representative apparatus and methods, and illustrative examples shown and described. Accordingly, departures may be made from such details without departing from the spirit or scope of applicant's general inventive concept.

Having thus described the aforementioned invention, I claim:

1. A device for shaping a pastel stick and storing pastel powder from the pastel stick, said device comprising:

a powder receptacle defining an opening and an interior volume accessible through said opening;

a screen removably carried by said powder receptacle in said opening, said screen defining a surface for shaping a pastel stick, whereby pastel powder generated by shaping the pastel stick is received in said powder receptacle through said screen; and a lid for securing said screen and for selectively sealing said interior volume, said lid including:

a lid ring configured to be received over said powder receptacle opening and said screen such that said screen is securely mounted on said powder receptacle, said lid ring defining an opening to cooperate with said powder receptacle opening for receiving a pastel stick to be shaped; and a seal member configured to be removably received between said screen and said lid ring when said screen is mounted on said powder receptacle and between said powder receptacle and said lid ring when said screen is removed, said seal member being further configured to cover said lid ring opening such that powder received within said powder receptacle is retained when said lid ring and said seal member are mounted on said powder receptacle.

2. The device of claim 1 wherein screen defines a selected three-dimensional geometric configuration for achieving a selected geometric configuration on an end of the pastel stick, said screen defining an upper end and a lower end, said lower end extending into said powder receptacle.

3. The device of claim 2 wherein said screen defines a conical configuration for achieving a conical point on the pastel stick.

4. The device of claim 2 wherein said screen defines a collar at said upper end thereof, said collar being configured to be received between said powder receptacle and said lid.

5. The device of claim 1 wherein said powder receptacle is transparent, whereby contents within said powder receptacle are readily discernable.

6. The device of claim 1 wherein said powder receptacle defines a threaded portion about said powder receptacle opening, and wherein said lid ring defines a cooperating threaded portion, whereby said lid ring is selectively and threadably engaged with said powder receptacle for selectively securing at least one of said screen and said seal member to said powder receptacle.

7. The device of claim 1 further comprising at least one ring configured to be received between said screen and one of said powder receptacle and said lid ring, each of said at least one ring being configured to define an opening to cooperate with said lid ring opening and said powder receptacle opening for receiving a pastel stick to be shaped.

8. A device for shaping a pastel stick and storing pastel powder from the pastel stick, said device comprising:

a powder receptacle defining an opening and an interior volume accessible through said opening;

a screen removably carried by said powder receptacle in said opening, said screen defining a surface for shaping a pastel stick, whereby pastel powder generated by shaping the pastel stick is received in said powder receptacle through said screen, said screen defining a selected three-dimensional geometric configuration for achieving a selected geometric configuration on an end of the pastel stick, said screen defining an upper end and a lower end, said lower end extending into said powder receptacle; and a lid for securing said screen and for selectively sealing said interior volume, said lid including:

a lid ring configured to be received over said powder receptacle opening and said screen such that said screen is securely mounted on said powder receptacle, said lid ring defining an opening to cooperate with said powder receptacle opening for receiving a pastel stick to be shaped; and a seal member configured to be removably received between said screen and said lid ring when said screen is mounted on said powder receptacle and between said powder receptacle and said lid ring when said screen is remover, said seal member being further configured to cover said lid ring opening such that powder received within said powder receptacle is retained when said lid ring and said seal member are mounted on said powder receptacle.

9. The device of claim 8 wherein said screen defines a conical configuration for achieving a conical point on the pastel stick.

10. The device of claim 8 wherein said screen defines a collar at said upper end thereof, said collar being configured to be received between said powder receptacle and said lid.

11. The device of claim 8 wherein said powder receptacle is transparent, whereby contents within said powder receptacle are readily discernable.

12. The device of claim 8 wherein said powder receptacle defines a threaded portion about said powder receptacle opening, and wherein said lid ring defines a cooperating threaded portion, whereby said lid ring is selectively and threadably engaged with said powder receptacle for selectively securing at least one of said screen and said seal member to said powder receptacle.

13. The device of claim 8 further comprising at least one ring configured to be received between said screen and one of said powder receptacle and said lid ring, each of said at least one ring being configured to define an opening to cooperate with said lid ring opening and said powder receptacle opening for receiving a pastel stick to be shaped.

14. A device for shaping a pastel stick and storing pastel powder from the pastel stick, said device comprising:

a powder receptacle defining an opening and an interior volume accessible through said opening;

a screen removably carried by said powder receptacle in said opening, said screen defining a surface for shaping a pastel stick, whereby pastel powder generated by shaping the pastel stick is received in said powder receptacle through said screen, said screen defining a selected three-dimensional geometric configuration for achieving a selected geometric configuration on an end of the pastel stick, said screen defining an upper end and a lower end, said lower end extending into said powder receptacle;

a lid for securing said screen and for selectively sealing said interior volume, said lid including:

a lid ring configured to be received over said powder receptacle opening and said screen such that said screen is securely mounted on said powder receptacle, said lid ring defining an opening to cooperate with said powder receptacle opening for receiving a pastel stick to be shaped; and a seal member configured to be removably received between said screen and said lid ring when said screen is mounted on said powder receptacle and between said powder receptacle and said lid ring when said screen is remover, said seal member being further configured to cover said lid ring opening such that powder received within said powder receptacle is retained when said lid ring and said seal member are mounted on said powder receptacle;

a first ring configured to be received between said screen and said powder receptacle, said first ring being configured to define an opening to cooperate with said powder receptacle opening for receiving said lower end of said screen; and a second ring configured to be received between said screen and said lid ring, said second ring being configured to define an opening to cooperate with said lid ring opening for receiving a pastel stick to be shaped.

15. The device of claim 14 wherein said screen defines a conical configuration for achieving a conical point on the pastel stick.

16. The device of claim 14 wherein said screen defines a collar at said upper end thereof, said collar being configured to be received between said powder receptacle and said lid.

17. The device of claim 14 wherein said powder receptacle is transparent, whereby contents within said powder receptacle are readily discernable.

18. The device of claim 14 wherein said powder receptacle defines a threaded portion about said powder receptacle opening, and wherein said lid ring defines a cooperating threaded portion, whereby said lid ring is selectively and threadably engaged with said powder receptacle for selectively securing at least one of said screen and said seal member to said powder receptacle.

* * * * *